US009722319B2

(12) United States Patent
Liu et al.

(10) Patent No.: US 9,722,319 B2
(45) Date of Patent: Aug. 1, 2017

(54) METAMATERIAL ANTENNA

(75) Inventors: Ruopeng Liu, Shenzhen (CN); Chunlin Ji, Shenzhen (CN); Yutao Yue, Shenzhen (CN); Qing Yang, Shenzhen (CN)

(73) Assignee: KUANG-CHI INNOVATIVE TECHNOLOGY LTD., Shenzhen (CN)

( * ) Notice: Subject to any disclaimer, the term of this patent is extended or adjusted under 35 U.S.C. 154(b) by 187 days.

(21) Appl. No.: 14/353,028

(22) PCT Filed: Apr. 9, 2012

(86) PCT No.: PCT/CN2012/073681

§ 371 (c)(1),
(2), (4) Date: Apr. 20, 2014

(87) PCT Pub. No.: WO2013/060115

PCT Pub. Date: May 2, 2013

(65) Prior Publication Data

US 2014/0292615 A1 Oct. 2, 2014

(30) Foreign Application Priority Data

Oct. 27, 2011 (CN) ..... 2011 1 0331087
Oct. 27, 2011 (CN) ..... 2011 1 0331138

(51) Int. Cl.
*H01Q 15/10* (2006.01)
*H01Q 15/14* (2006.01)
(Continued)

(52) U.S. Cl.
CPC ..... *H01Q 15/14* (2013.01); *H01Q 15/0053* (2013.01); *H01Q 15/0086* (2013.01);
(Continued)

(58) Field of Classification Search
CPC .. H01Q 15/14; H01Q 15/0086; H01Q 19/062; H01Q 15/23; H01Q 19/10;
(Continued)

(56) References Cited

U.S. PATENT DOCUMENTS 2,403,660 A * 7/1946 Hayward ..... G02B 17/0808 359/729
2,730,013 A * 1/1956 Mandler ..... G02B 17/0808 359/731
(Continued)

FOREIGN PATENT DOCUMENTS

CN 101587990 A 11/2009
CN 101699659 A 4/2010
(Continued)

OTHER PUBLICATIONS

Gang Zhao, "A Study of Microstrip Reflectarrays and Low Profile Resonant Cavity Antenna," Doctoral Dissertation, Xidian University, China, Jan. 31, 2011.
(Continued)

*Primary Examiner* — Dieu H. Duong
*Assistant Examiner* — Bamidele A Jegede
(74) *Attorney, Agent, or Firm* — Perkins Coie LLP

(57) ABSTRACT

The disclosure relates to a metamaterial antenna, where the metamaterial antenna includes an enclosure, a feed, a first metamaterial that clings to an aperture edge of the feed, a second metamaterial that is separated by a preset distance from the first metamaterial and is set oppositely, and a third metamaterial that clings to an edge of the second metamaterial, where the enclosure, the feed, the first metamaterial, the second metamaterial, and the third metamaterial make up a closed cavity; and a central axis of the feed penetrates center points of the first metamaterial and the second metamaterial; and a reflection layer for reflecting an electromag-
(Continued)

netic wave is set on surfaces of the first metamaterial and the second metamaterial, where the surfaces are located outside the cavity.

13 Claims, 8 Drawing Sheets

(51) Int. Cl.

| | |
|---|---|
| ***H01Q 15/23*** | (2006.01) |
| ***H01Q 19/10*** | (2006.01) |
| ***H01Q 15/00*** | (2006.01) |
| ***H01Q 19/06*** | (2006.01) |
| ***H01Q 19/18*** | (2006.01) |
| *H01Q 19/02* | (2006.01) |

(52) U.S. Cl.
CPC ..... *H01Q 15/10* (2013.01); *H01Q 15/23* (2013.01); *H01Q 19/062* (2013.01); *H01Q 19/10* (2013.01); *H01Q 19/18* (2013.01); *H01Q 19/027* (2013.01)

(58) Field of Classification Search
CPC .... H01Q 15/0053; H01Q 15/10; H01Q 19/18; H01Q 19/027
USPC ..... 343/912, 909, 725, 753–756
See application file for complete search history.

(56) References Cited

U.S. PATENT DOCUMENTS

| | | | | | |
|---|---|---|---|---|---|
| 3,438,695 | A * | 4/1969 | Matsui | G02B 17/0808 | 359/731 |
| 4,220,957 | A | 9/1980 | Britt | | |
| 4,307,404 | A * | 12/1981 | Young | H01Q 3/14 | 343/754 |
| 4,599,623 | A * | 7/1986 | Havkin | H01Q 19/195 | 343/756 |
| 4,652,891 | A * | 3/1987 | Bossuet | H01Q 19/195 | 343/756 |
| 4,864,321 | A * | 9/1989 | Sureau | H01Q 15/0013 | 343/700 MS |
| 5,497,169 | A * | 3/1996 | Wu | H01Q 15/0033 | 333/134 |
| 5,680,139 | A | 10/1997 | Huguenin et al. | | |
| 5,681,139 | A * | 10/1997 | Szanto | B62B 3/0637 | 254/4 C |
| 6,252,559 | B1 * | 6/2001 | Donn | H01Q 19/19 | 343/756 |
| 6,351,247 | B1 * | 2/2002 | Linstrom | H01Q 3/46 | 342/368 |
| 6,774,861 | B2 * | 8/2004 | Choung | H01Q 19/192 | 343/781 CA |
| 7,570,432 | B1 * | 8/2009 | Yonak | G02B 3/0087 | 359/652 |
| 2005/0017916 | A1 | 1/2005 | Lewry et al. | | |
| 2010/0033389 | A1 * | 2/2010 | Yonak | H01Q 15/08 | 343/755 |
| 2010/0066639 | A1 | 3/2010 | Ngyuen et al. | | |
| 2010/0259345 | A1 * | 10/2010 | Kim | H01Q 15/0086 | 333/239 |
| 2010/0308668 | A1 * | 12/2010 | Rofougaran | H01Q 1/2283 | 307/149 |
| 2011/0095953 | A1 * | 4/2011 | Lier | H01Q 15/02 | 343/755 |
| 2011/0262145 | A1 * | 10/2011 | Ruggiero | G02B 17/0856 | 398/115 |

FOREIGN PATENT DOCUMENTS

| | | | | |
|---|---|---|---|---|
| CN | 201450116 | U | 5/2010 | |
| CN | 101867094 | A | 10/2010 | |
| CN | 102480024 | B * | 3/2013 | H01Q 15/00 |
| DE | 4412769 | A1 | 10/1995 | |
| GB | 2234858 | A | 2/1991 | |

OTHER PUBLICATIONS

D. Pilz and W. Menzel, "Folded Reflectarray Antenna," Electronics Letters, vol. 34, No. 9, pp. 832-833, Apr. 30, 1998.

Wenxuan Tang et al: "Discrete Coordinate Transformation for Designing All-Dielectric Flat Antennas", IEEE Transactions on Antennas and Propagation, vol. 58, No. 12, Dec. 1, 2010 (Dec. 1, 2010 ), pp. 3795-3804, XP055204372, ISSN: 0018-926X, DOI: 10.1109/T AP.2010.2078475.

Ashwin K. Iyer et al: "Artificial Dielectrics" In: "Negative-Refraction Metamaterials, Fundamental Principles and Applications", Jan. 1, 2005 (Jan. 1, 2005), John Wiley & Sons, New Jersey, XP055204382, ISBN: 978-0-47-160146-3 pp. 4-5.

* cited by examiner

METAMATERIAL ANTENNA

TECHNICAL FIELD

The disclosure relates to the field of antennas, and in particular, to a metamaterial antenna.

BACKGROUND

"Metamaterial" refers to an artificial composite structure or a composite material with certain extraordinary physical properties that natural materials lack. Through sequential structure design of key physical dimensions of the material, limitations of certain apparent natural laws can be broken through, so as to obtain extraordinary material functions that go beyond inherent ordinary properties of the nature.

The refractive index profile inside the metamaterial is a key part for the metamaterial to demonstrate extraordinary functions. Different refractive index profile corresponds to different functions. With higher precision of the refractive index profile, the implemented functions are better. For conventional antennas, especially horn antennas, their aperture efficiency imposes great impact on improvement of antenna directivity and gain, and good far-field radiation responses are not available. In addition, dimensions of the antennas in the prior art are large and hardly reducible.

SUMMARY

A technical issue to be solved by the disclosure is to provide a metamaterial in view of defects of difficulty of obtaining good far-field radiation responses and reducing dimensions in the prior art.

A technical solution to the technical issue of the disclosure is: making a metamaterial antenna, which includes an enclosure, a feed, a first metamaterial that clings to an aperture edge of the feed, a second metamaterial that is separated by a preset distance from the first metamaterial and is set oppositely, and a third metamaterial that clings to an edge of the second metamaterial, where the enclosure, the feed, the first metamaterial, the second metamaterial, and the third metamaterial make up a closed cavity; and a central axis of the feed penetrates center points of the first metamaterial and the second metamaterial; and a reflection layer for reflecting an electromagnetic wave is set on surfaces of the first metamaterial and the second metamaterial, where the surfaces are located outside the cavity.

In the metamaterial antenna described in the disclosure, a central region of the second metamaterial is a through-hole.

In the metamaterial antenna described in the disclosure, an electromagnetic wave emitted to the second metamaterial passes through the reflection layer and then bypasses the feed and is reflected onto the first metamaterial; and an electromagnetic wave emitted to the first metamaterial passes through the reflection layer and then bypasses the second metamaterial and is reflected onto the third metamaterial.

In the metamaterial antenna described in the disclosure, the first metamaterial includes multiple first metamaterial sheet layers, each first metamaterial sheet layer includes a first substrate and multiple first artificial metal microstructures that are cyclically distributed on the first substrate, refractive indexes at different points of the first metamaterial sheet layer are distributed in a circular shape, a refractive index at a circle center is smallest, the refractive indexes increase gradually with increase of a radius that uses a center point of the first metamaterial sheet layer as a circle center, and, the refractive index is the same at the same radius.

In the metamaterial antenna described in the disclosure, the second metamaterial is used to convert the electromagnetic wave emitted onto the second metamaterial into a plane wave through reflection, and then emit the plane wave onto the first metamaterial, and, by using a center point of the second metamaterial as a circle center, the refractive index $n_2(y)$ at a radius y satisfies the following formula:

$$n_2(y) = n_{min2} + \frac{1}{d_2} * \left(ss + |y| * \sin\theta_2 - \sqrt{ss^2 + y^2}\right); \text{ and}$$

$$\sin\theta_2 \geq \frac{r_k}{\sqrt{r_k^2 + ss^2}},$$

$n_{min2}$ is a minimum refractive index of the second metamaterial, $d_2$ is thickness of the second metamaterial, ss is a distance from the feed to the second metamaterial, and $r_k$ is a radius of an aperture plane of the feed.

In the metamaterial antenna described in the disclosure, the second metamaterial includes multiple second metamaterial sheet layers, each second metamaterial sheet layer includes a second substrate and multiple second artificial metal microstructures that are cyclically distributed on the second substrate, refractive indexes at different points of the second metamaterial sheet layer are distributed in a circular shape, a refractive index at a circle center is smallest, the refractive indexes increase gradually with increase of a radius that uses a center point of the second metamaterial sheet layer as a circle center, and, the refractive index is the same at the same radius.

In the metamaterial antenna described in the disclosure, the first metamaterial is used to convert the electromagnetic wave emitted onto the first metamaterial into a plane wave through reflection, and then emit the plane wave onto the third metamaterial, and, by using a center point of the first metamaterial as a circle center, the refractive index $n_1(y)$ at a radius y satisfies the following formula:

$$n_1(y) = n_{min1} + \frac{1}{d_1} * (|y| - r_k) * (\sin\theta_1 - \sin\theta_2);$$

$$\sin\theta_1 \geq \frac{r_2 - r_k}{\sqrt{(r_2 - r_k)^2 + ss^2}}; \text{ and}$$

$$\sin\theta_2 \geq \frac{r_k}{\sqrt{r_k^2 + ss^2}},$$

where, $n_{min1}$ is a minimum refractive index of the first metamaterial, $d_1$ is thickness of the first metamaterial, ss is a distance from the feed to the second metamaterial, and $r_k$ is a radius of an aperture plane of the feed.

In the metamaterial antenna described in the disclosure, the third metamaterial includes a function layer formed by stacking multiple functional metamaterial sheet layers of the same thickness and the same refractive index profile, each functional metamaterial sheet layer includes a third substrate and multiple third artificial metal microstructures that are cyclically distributed on the third substrate, refractive indexes of the functional metamaterial sheet layer are distributed in a concentric circle shape that uses a center point of the functional metamaterial sheet layer as a circle center, a refractive index at the circle center is greatest, and, the refractive index is the same at the same radius; and a refractive index profile on the functional metamaterial sheet layer is obtained according to the following steps:

S1: determining a region in which the third metamaterial is located and a boundary of each functional metamaterial sheet layer, where the region of the third metamaterial is filled with air, fixing the feed in front of the region of the third metamaterial and causing a central axis of the feed to coincide with a central axis of the region of the third metamaterial; and, after the feed emits an electromagnetic wave, testing and recording an initial phase on a front surface of the $i^{th}$ functional metamaterial sheet layer on the functional layer of the third metamaterial, where an initial phase at each point on the front surface of the $i^{th}$ functional metamaterial sheet layer is denoted by $\phi_{i0}(y)$, and an initial phase at the central axis is denoted by $\phi_{i0}(0)$;

S2: according to a formula $$\Psi = \varphi_{i0}(0) - \frac{\sum_{i}^{M} n_{max3} d}{\lambda} * 2\pi,$$

obtaining a phase $\Psi$ on a back surface of the third metamaterial, where, M is a total number of the functional metamaterial sheet layers that make up the functional layer of the third metamaterial, d is thickness of each functional metamaterial sheet layer, $\lambda$ is a wavelength of the electromagnetic wave emitted by the feed, and $n_{max3}$ is a maximum refractive index value of the functional metamaterial sheet layer; and S3: according to the initial phase $\phi_{i0}(y)$ obtained through the test in step S1, the reference phase $\Psi$ obtained in step S2, and the formula $$\Psi = \varphi_{i0}(y) - \frac{\sum_{i}^{M} n_3(y) d}{\lambda} * 2\pi,$$

obtaining a refractive index profile of $n_3(y)$ of the functional metamaterial sheet layer, where, y is a distance from any point on the functional metamaterial sheet layer to the central axis of the functional metamaterial sheet layer.

In the metamaterial antenna described in the disclosure, the third metamaterial further includes the first to the $N^{th}$ impedance matching layers that are symmetrically set on both sides of the functional layer, where two $N^{th}$ impedance matching layers cling to the functional layer.

In the metamaterial antenna described in the disclosure, the first to the $N^{th}$ impedance matching layers are the first to the $N^{th}$ matching metamaterial sheet layers, each matching metamaterial sheet layer includes a fourth substrate and multiple fourth artificial metal microstructures that are cyclically distributed on the fourth substrate, refractive indexes of each matching metamaterial sheet layer are distributed in a concentric circle shape that uses a center point of the matching metamaterial sheet layer as a circle center, a refractive index at the circle center is greatest, and, the refractive index is the same at the same radius; and, on the first to the $N^{th}$ matching metamaterial sheet layers, the refractive indexes at the same radius are different.

In the metamaterial antenna described in the disclosure, a relationship between the refractive index profile of the first to the $N^{th}$ matching metamaterial sheet layers and the refractive index profile $n_3(y)$ of the functional metamaterial sheet layer is:

$$N(y)_j = n_{min3} + \frac{j}{N+1} * (n_3(y) - n_{min3}),$$

where, j represents serial numbers of the first to the $N^{th}$ matching metamaterial sheet layers, and $n_{min3}$ is a minimum refractive index value of the functional metamaterial sheet layer.

In the metamaterial antenna described in the disclosure, the third substrate and the fourth substrate are made of the same material, and the third substrate and the fourth substrate are made of a polymer material, a ceramic material, a ferroelectric material, a ferrite material, or a ferromagnetic material.

In the metamaterial antenna described in the disclosure, the third artificial microstructure and the fourth artificial microstructure have the same material and geometry.

In the metamaterial antenna described in the disclosure, the third artificial microstructure and the fourth artificial microstructure are metal microstructures of an H-shaped geometry, and the metal microstructures include an upright first metal branch and two second metal branches that are located at both ends of the first metal branch and vertical to the first metal branch.

In the metamaterial antenna described in the disclosure, the metal microstructures further include third metal branches that are located at both ends of each second metal branch and vertical to the second metal branch.

In the metamaterial antenna described in the disclosure, the third artificial microstructure and the fourth artificial microstructure are metal microstructures of a planar snowflake geometry, and the metal microstructures include two first metal branches that are vertical to each other and second metal branches that are located at both ends of the first metal branches and vertical to the first metal branches.

Implementation of the technical solution of the disclosure brings the following beneficial effects: the disclosure uses distinctive electromagnetic properties of the metamaterial, and performs reflection of the electromagnetic wave for multiple times to improve aperture efficiency of the antenna and accomplish good far-field radiation field responses. In addition, the design of reflecting the electromagnetic wave for multiple times reduces thickness of the antenna significantly and makes an antenna system smaller.

BRIEF DESCRIPTION OF DRAWINGS

The following describes the disclosure in more detail with reference to accompanying drawings and embodiments. In the accompanying drawings.

DETAILED DESCRIPTION

Light is a type of electromagnetic wave. When light penetrates glass, because the wavelength of the light is far greater than the dimensions of an atom, we can describe a response of the glass to the light by using overall parameters such as a refractive index of the glass rather than detailed parameters of the atoms that make up the glass. Correspondingly, in researching the response of a material to other electromagnetic waves, the response of any structure in the material to the electromagnetic wave may also be described by the overall parameters such as permittivity $\epsilon$ and permeability $\mu$ of the material, where the dimensions of the structure are far smaller than the wavelength of the electromagnetic wave. Through design of the structure at each point of the material, the permittivity and the permeability at each point of the material are the same or different, so that the overall permittivity and the overall permeability of the material are distributed regularly to some extent. The regularly distributed permeability and permittivity can cause the material to make a macroscopic response to the electromagnetic wave, for example, converging the electromagnetic wave, diverging the electromagnetic wave, and the like. Such a material with regularly distributed permeability and permittivity is called metamaterial.

Figure 1:
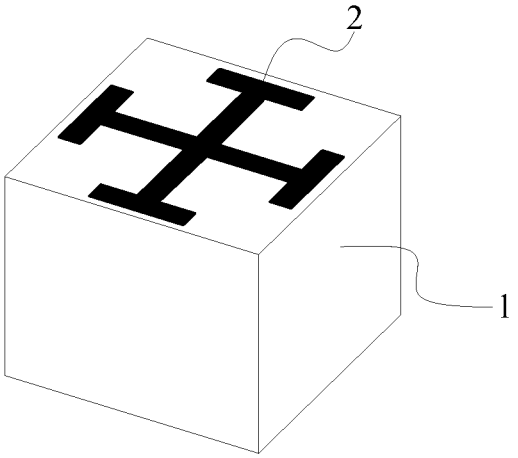
FIG. 1 is a three-dimensional schematic structural diagram of basic units that make up a metamaterial.

As shown in FIG. 1, which is a three-dimensional schematic structural diagram of basic units that make up a metamaterial. A basic unit of the metamaterial includes an artificial microstructure 1 and a substrate 2 to which the artificial microstructure is attached. In the disclosure, the artificial microstructure is an artificial metal microstructure 1. The artificial metal microstructure 1 has a planar or three-dimensional topology structure that can respond to an electric field and/or a magnetic field of an incident electromagnetic wave. Once the pattern and/or dimensions of the artificial metal microstructure on each basic unit of the metamaterial are changed, the response of each basic unit of the metamaterial to the incident electromagnetic wave can be changed. When multiple basic units of the metamaterial are arranged according to a certain rule, the metamaterial can make a macroscopic response to the electromagnetic wave. Because the metamaterial as an entirety needs to have a macroscopic electromagnetic response to the incident electromagnetic wave, responses made by each basic unit of the metamaterial to the incident electromagnetic wave need to be continuous responses, which requires that the dimensions of each basic unit of the metamaterial are one-tenth to one-fifth of the incident electromagnetic wave, and preferably, one-tenth of the incident electromagnetic wave. In the description in this paragraph, the entirety of the metamaterial is intentionally divided into multiple basic units of the metamaterial. However, it should be noted that the division method is for ease of description only but does not mean that the metamaterial is spliced or assembled from multiple basic units of the metamaterial. In practical application, the metamaterial is formed by distributing artificial metal microstructures on the substrate cyclically, in which the process is simple and the cost is low. Cyclic distribution means that the artificial metal microstructures on each basic unit of the metamaterial, which is a result of intentional division, can make continuous electromagnetic responses to the incident electromagnetic wave. In the disclosure, the substrate 2 may be made of a polymer material, a ceramic material, a ferroelectric material, a ferrite material, or a ferromagnetic material, and FR-4 or F4B is preferred as the polymer material. The artificial metal microstructure 1 may be cyclically distributed on the substrate 2 by means of etching, plating, drill lithography, photolithography, electron lithography, or ion lithography. The etching is a preferred process, and its steps are to lay a metal sheet over the substrate, and then use chemical solvents to remove metal except the preset artificial metal pattern.

In the disclosure, the metamaterial principles are used to design the overall refractive index profile of the metamaterial properly, and then according to the refractive index profile, the artificial metal microstructures are cyclically distributed on the substrate to change electromagnetic responses of an incident electromagnetic wave, so as to implement desired functions.

Figure 2:
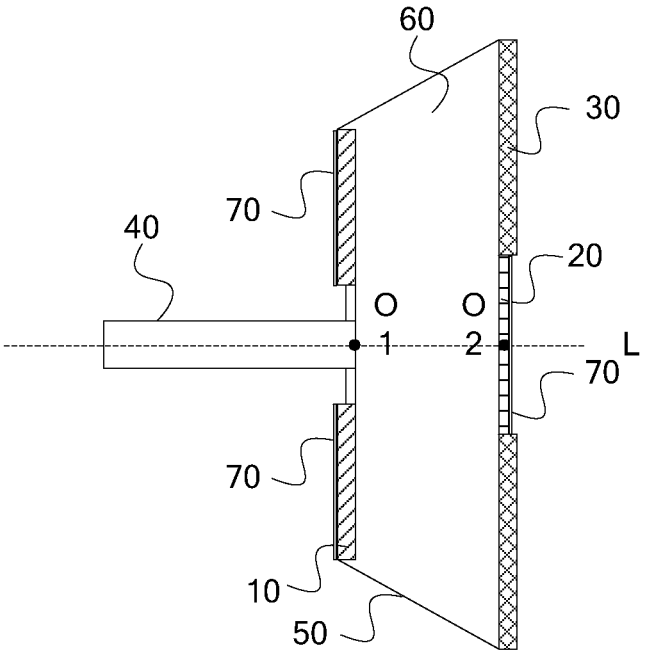
FIG. 2 is a lateral view of a metamaterial antenna according to an embodiment of the disclosure.

FIG. 2 is a lateral view of a metamaterial antenna. The metamaterial antenna includes an enclosure 50, a feed 40, a first metamaterial 10 (filled with oblique lines in FIG. 2) that clings to an aperture edge of the feed 40, a second metamaterial 20 (filled with horizontal lines in FIG. 2) that is separated by a preset distance from the first metamaterial 10 and is set oppositely, and a third metamaterial 30 (filled with grids in FIG. 2) that clings to an edge of the second metamaterial 20, where the enclosure 50, the feed 40, the first metamaterial 10, the second metamaterial 20, and the third metamaterial 30 make up a closed cavity 60. The enclosure 50 may be designed by using but without being limited to a PEC (Perfect Electric Conductor).

A central axis L of the feed 40 penetrates the center point O1 of the first metamaterial 10 and the center point O2 of the second metamaterial 20; and a reflection layer 70 for reflecting an electromagnetic wave is set on surfaces of the first metamaterial 10 and the second metamaterial 20, where the surfaces are located outside the cavity. The electromagnetic wave emitted by the feed 40 is reflected in the cavity 60 for multiple times and then emitted through the third metamaterial 30.

Figure 3:
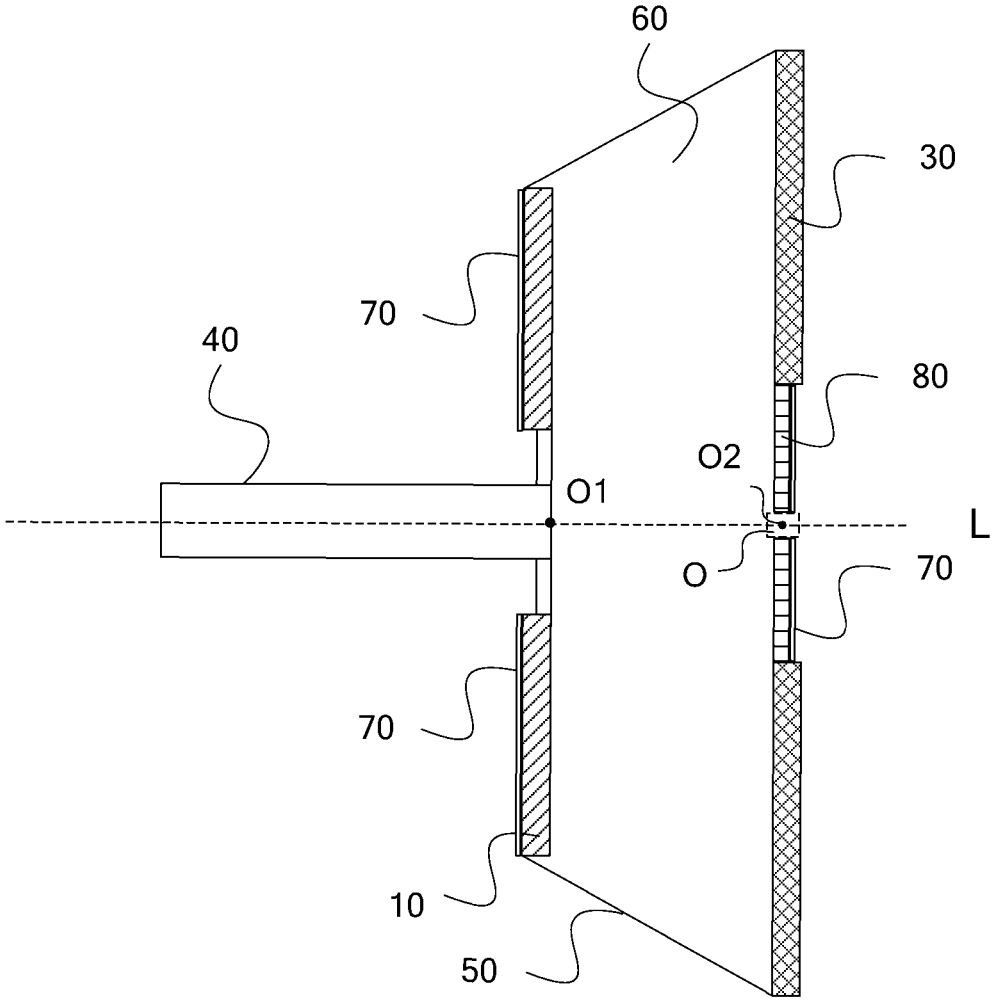
FIG. 3 is a lateral view of a metamaterial antenna according to another embodiment of the disclosure.

In other embodiments, as shown in FIG. 3, which is a lateral view of a metamaterial antenna according to another embodiment of the disclosure, where the central region of the second metamaterial 80 is a through-hole O (in a location indicated by a dotted box). The through-hole O causes a part of the electromagnetic wave emitted by the feed 40 to emit, where the part has the highest energy, thereby effectively preventing loss caused by emitting the electromagnetic wave to an aperture plane of the feed 40, enhancing a peak value of a main lobe, and reducing the level of a side lobe. In FIG. 3, except that the central region of the second metamaterial 80 is a through-hole O, other structures are the same as the structures shown in FIG. 2.

Figure 4:
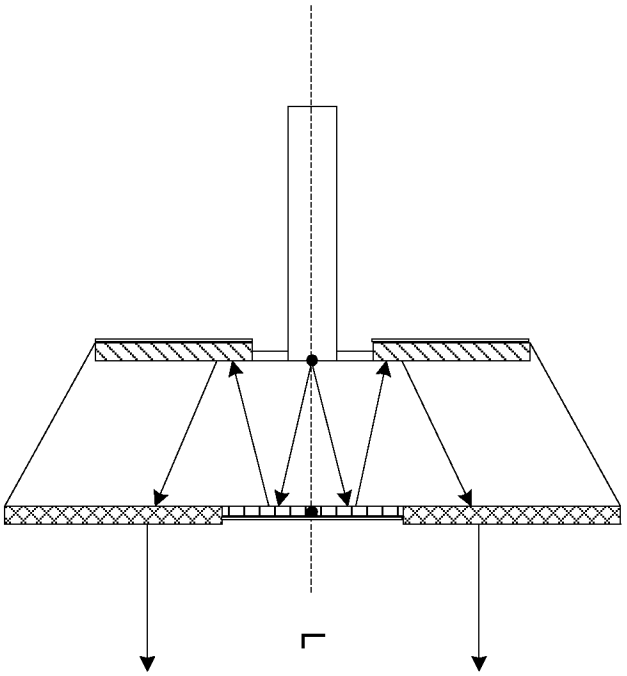
FIG. 4 is a schematic diagram of a propagation path of an electromagnetic wave in the metamaterial antenna shown in FIG. 2.
Figure 5:
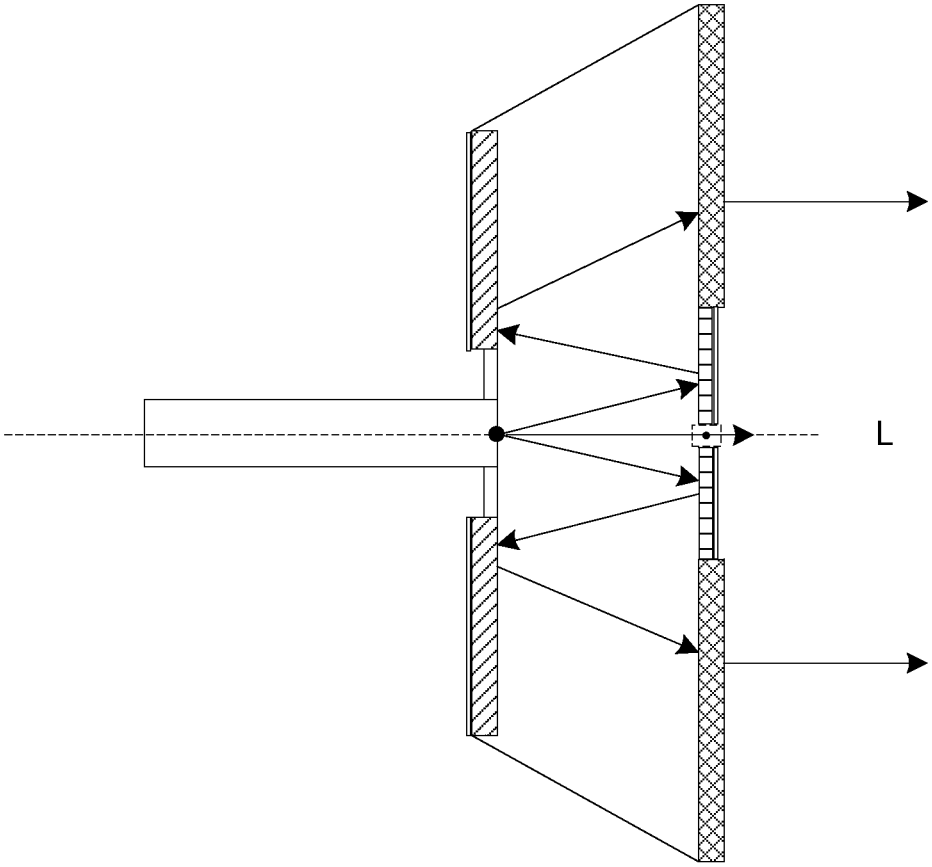
FIG. 5 is a schematic diagram of a propagation path of an electromagnetic wave in the metamaterial antenna shown in FIG. 3.

An electromagnetic wave emitted to the second metamaterial 20 or the second metamaterial 80 passes through the reflection layer 70 and then bypasses the feed 40 and is reflected onto the first metamaterial 10; and an electromagnetic wave emitted to the first metamaterial 10 passes through the reflection layer and then bypasses the second metamaterial 20 and is reflected onto the third metamaterial 30, and, after passing through the third metamaterial, the electromagnetic wave is converted into a plane wave and then emitted, as shown in FIG. 4 or FIG. 5. The electromagnetic wave path shown in FIG. 4 or FIG. 5 is merely illustrative, and describes functions of each metamaterial but is not intended to restrict the disclosure. The reflection layer 70 may be designed by using but without being limited to a PEC board so long as the reflection function can be implemented.

The second metamaterial 20 includes multiple second metamaterial sheet layers, each second metamaterial sheet layer includes a second substrate and multiple second artificial metal microstructures that are cyclically distributed on the second substrate, refractive indexes at different points of the second metamaterial sheet layer are distributed in a circular shape, a refractive index at a circle center is smallest, the refractive indexes increase gradually with increase of a radius that uses a center point of the second metamaterial sheet layer as a circle center, and, the refractive index is the same at the same radius.

The second metamaterial 20 is used to convert the electromagnetic wave emitted onto the second metamaterial into a plane wave through reflection, and then emit the plane wave onto the first metamaterial 10. In an embodiment of the disclosure, the refractive index $n_2(y)$ at the radius y that uses the center point O2 of the second metamaterial 20 as a circle center satisfies the following formula:

$$n_2(y) = n_{min2} + \frac{1}{d_2} * \left(ss + |y| * \sin\theta_2 - \sqrt{ss^2 + y^2}\right); \text{ and}$$

$$\sin\theta_2 \geq \frac{r_k}{\sqrt{r_k^2 + ss^2}},$$

Figure 6:
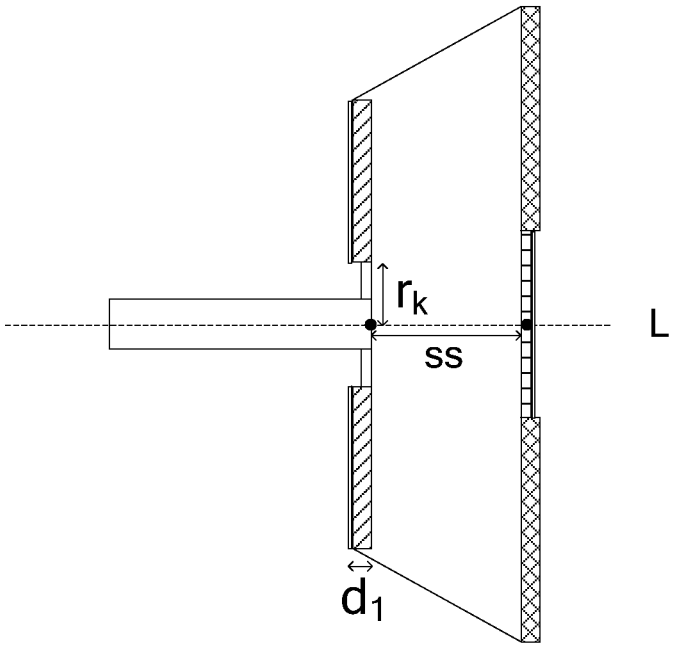
FIG. 6 is a schematic diagram of parameters required in design of the metamaterial antenna shown in FIG. 2.
Figure 7:
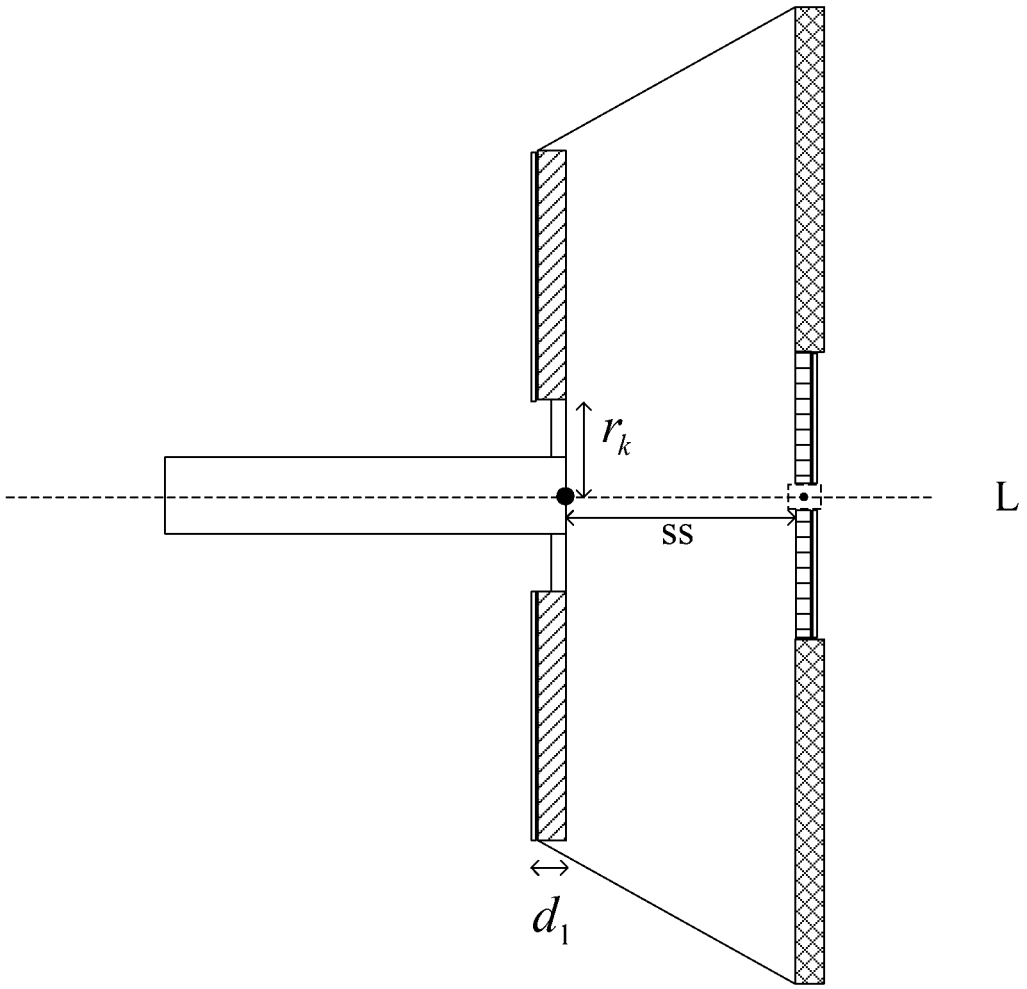
FIG. 7 is a schematic diagram of parameters required in design of the metamaterial antenna shown in FIG. 3.

$n_{min2}$ is a minimum refractive index of the second metamaterial 20, $d_2$ is thickness of the second metamaterial 20, ss is a distance from the feed 40 to the second metamaterial 20, and $r_k$ is a radius of an aperture plane of the feed 40, as shown in FIG. 6 or FIG. 7.

The first metamaterial 10 includes multiple first metamaterial sheet layers, each first metamaterial sheet layer includes a first substrate and multiple first artificial metal microstructures that are cyclically distributed on the first substrate, refractive indexes at different points of the first metamaterial sheet layer are distributed in a circular shape, a refractive index at a circle center is smallest, the refractive indexes increase gradually with increase of a radius that uses a center point of the first metamaterial sheet layer as a circle center, and, the refractive index is the same at the same radius.

The first metamaterial 10 is used to convert the electromagnetic wave emitted onto the first metamaterial into a plane wave through reflection, and then emit the plane wave onto the third metamaterial 30, and, by using a center point O1 of the first metamaterial 10 as a circle center, the refractive index $n_1(y)$ at a radius y satisfies the following formula:

$$n_1(y) = n_{min1} + \frac{1}{d_1} * (|y| - r_k) * (\sin\theta_1 - \sin\theta_2);$$

$$\sin\theta_1 \geq \frac{r_2 - r_k}{\sqrt{(r_2 - r_k)^2 + ss^2}}; \text{ and}$$

$$\sin\theta_2 \geq \frac{r_k}{\sqrt{r_k^2 + ss^2}},$$

$n_{min1}$ is a minimum refractive index of the first metamaterial 10, $d_1$ is thickness of the first metamaterial 10, ss is a distance from the feed 40 to the second metamaterial 20, and $r_k$ is a radius of an aperture plane of the feed 40.

For design of the refractive indexes on the metamaterial, a conventional design method is a formula method, that is, the corresponding refractive index value at each point of the metamaterial is obtained by using a principle of approximately equal optical path lengths. The metamaterial refractive index profile obtained by using the formula method is applicable to simple system emulation design. However, in practical circumstances, the distribution of electromagnetic waves does not perfectly comply with the distribution of electromagnetic waves in software emulation. Therefore, for a sophisticated system, significant error exists in the metamaterial refractive index profile obtained by using the formula method.

The disclosure uses an initial phase method to design the refractive index profile of the third metamaterial 30, and the function to be implemented by the third metamaterial 30 in the disclosure is to convert the electromagnetic wave into a plane electromagnetic wave for emitting, so as to improve directivity of each electronic component. The third metamaterial 30 includes a function layer. The function layer is formed by stacking multiple functional metamaterial sheet layers of the same thickness and the same refractive index profile. Each functional metamaterial sheet layer includes a third substrate and multiple third artificial metal microstructures that are cyclically distributed on the third substrate. Refractive indexes of the functional metamaterial sheet layer are distributed in a concentric circle shape on a cross section of the functional metamaterial sheet layer, that is, points with the same refractive index on the functional metamaterial sheet layer make up a concentric circle. A refractive index at the circle center is greatest and is denoted by $n_{max3}$, and the maximum refractive index $n_{max3}$ is a definite value. Likewise, the refractive indexes of the functional metamaterial sheet layer are distributed on its vertical section in a vertically symmetric manner by using a central axis L as a symmetric axis. The refractive index on the central axis L is the maximum refractive index value $n_{max3}$.

Figure 8:
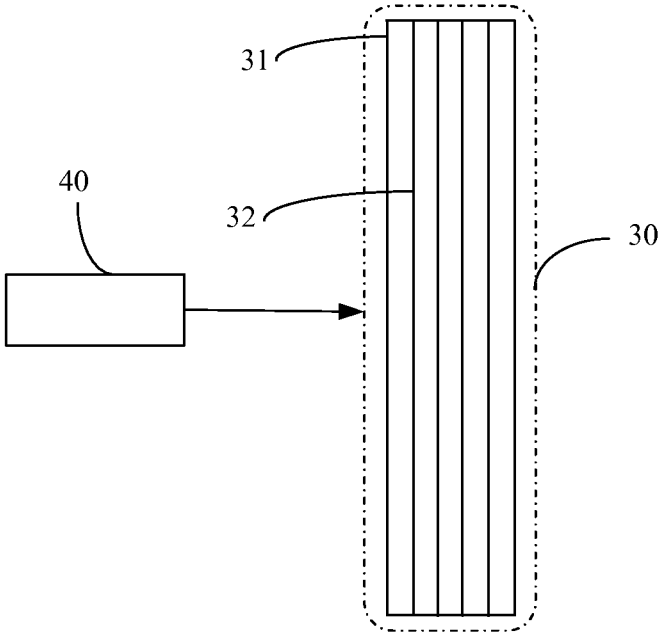
FIG. 8 is a schematic diagram of calculating a refractive index profile of a third metamaterial according to the disclosure.

The following expounds detailed steps of using an initial phase method to design the refractive index profile of the metamaterial:

S1: Determine a region in which the third metamaterial 30 is located and a boundary of each functional metamaterial sheet layer, where the region of the third metamaterial 30 is filled with air, fix the feed in front of the region of the third metamaterial 30 and cause a central axis of the feed to coincide with a central axis of the region of the third metamaterial 30. FIG. 8 includes a first layer of front surface 31 and a second layer of front surface 32 of the functional layer of the third metamaterial layer 30, and the feed 40. After the feed emits an electromagnetic wave, test and record an initial phase on a front surface of the $i^{th}$ functional metamaterial sheet layer on the functional layer of the third metamaterial 30, where an initial phase at each point on the front surface of the $i^{th}$ functional metamaterial sheet layer is denoted by $\phi_{i0}(y)$, and an initial phase at the central axis is denoted by $\phi_{i0}(0)$.

In the disclosure, the front surface refers to a surface close to the feed 40, and the back surface refers to a surface far away from the feed 40.

S2: According to a formula $$\Psi = \varphi_{i0}(0) - \frac{\sum_{i}^{M} n_{max3} d}{\lambda} * 2\pi,$$

obtain a phase $\Psi$ of the back surface of the third metamaterial 30, where, M is a total number of the functional metamaterial sheet layers that make up the functional layer of the third metamaterial 30, d is thickness of each functional metamaterial sheet layer, $\lambda$ is a wavelength of the electromagnetic wave emitted by the feed, and $n_{max3}$ is a maximum refractive index value of the functional metamaterial sheet layer.

In the above formula, because the objectives of the disclosure are that, after passing through the third metamaterial 30, the electromagnetic wave emitted by the feed is converted into a plane electromagnetic wave for emitting and the third metamaterial 30 takes on a plate shape, the back surface of the third metamaterial 30 needs to form an equal-phase plane. In the disclosure, the refractive index at the central axis L of the third metamaterial 30 is a definite value, and the phase at the central axis of the back surface of the third metamaterial 30 is a reference value.

S3: According to the initial phase $\phi_{i0}(y)$ obtained through the test in step S1, the reference phase $\Psi$ obtained in step S2, and the formula $$\Psi = \varphi_{i0}(y) - \frac{\sum_{i}^{M} n_3(y) d}{\lambda} * 2\pi,$$

obtain a refractive index profile $n_3(y)$ of the functional metamaterial sheet layer, where y is a distance from any point on the functional metamaterial sheet layer to the central axis L of the functional metamaterial sheet layer.

Preferably, a step further included after step S1 is: adjusting the initial phase $\phi_{i0}(y)$ obtained through test in step S1, so that the initial phase $\phi_{i0}(0)$ at the central axis of the metamaterial is the maximum value of $\phi_{i0}(y)$.

The disclosure may further obtain multiple refractive index profiles $n_3(y)$ of the functional layer of the metamaterial by selecting a different i value, that is, selecting a different functional metamaterial sheet layer front surface for testing, compare the obtained multiple refractive index profiles $n_3(y)$, and select a best result.

The foregoing steps of the disclosure can be easily programmed and coded. After they are programmed and coded, the user needs only to define a value boundary of the initial phase, and a computer can obtain the refractive index profile $n_3(y)$ of the metamaterial automatically, which facilitates mass popularization.

In addition, due to technical limitation, the minimum value $n_{min3}$ of the refractive index on the functional layer of the metamaterial can hardly reach a value close to that of air. Therefore, an abrupt change of the refractive index exists between the functional layer of the metamaterial and the air. Consequently, a part of the electromagnetic wave emitted onto the surface of the functional layer of the metamaterial is reflected, which leads to decrease of gain of the electronic component. To solve that problem, preferably in the disclosure, two impedance matching layers are set on both sides of the functional layer, and each impedance matching layer is formed of multiple matching metamaterial sheet layers. Each matching metamaterial sheet layer includes a fourth substrate and fourth artificial metal microstructures that are cyclically distributed on the fourth substrate. Each matching metamaterial sheet layer has equal thickness, which is all equal to the thickness of the functional metamaterial sheet layer. The refractive indexes at points corresponding to the same axis on different matching metamaterial sheet layers change gradually.

The relationship between the refractive index profile of the first to the $N^{th}$ matching metamaterial sheet layers and the refractive index profile $n_3(y)$ of the functional metamaterial sheet layer is:

$$N(y)_j = n_{min3} + \frac{j}{N+1} * (n_3(y) - n_{min3}),$$

where, j represents serial numbers of the first to the $N^{th}$ matching metamaterial sheet layers, the $N^{th}$ matching metamaterial sheet layer clings to the functional layer of the metamaterial, and $n_{min3}$ is a minimum refractive index value of the functional metamaterial sheet layer.

The artificial metal microstructures that satisfy the refractive index profile requirements of the functional metamaterial sheet layer and the matching metamaterial sheet layer have many types of geometry, but all of them are the geometry that can respond to the incident electromagnetic wave. The most typical one is an H-shaped artificial metal microstructure. The following describes several types of geometry of artificial metal microstructures in detail. The dimensions of the artificial metal microstructures corresponding to each point on the functional metamaterial sheet layer and the matching metamaterial sheet layer may be obtained through computer emulation or calculated manually. In the disclosure, to facilitate mass production, the third substrate and the fourth substrate of the functional metamaterial sheet layer and the matching metamaterial sheet layer are made of the same material, and the third metal microstructure and the fourth metal microstructure have the same geometry.

Figure 9:
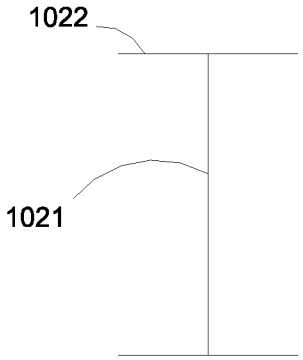
FIG. 9 is a geometry topology view of a first preferred implementation manner of artificial metal microstructures that can respond to an electromagnetic wave to change a refractive index of basic units of a metamaterial.
Figure 10:
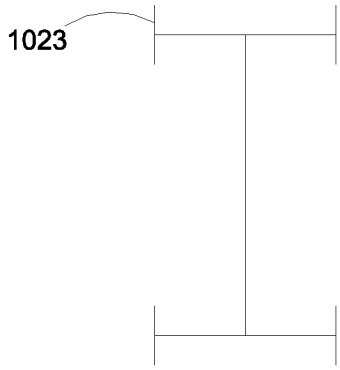
FIG. 10 is a derivative pattern of the topology view of the geometry of the artificial metal microstructures in FIG. 9.

As shown in FIG. 9, which is a geometry topology view of a first preferred implementation manner of artificial metal microstructures that can respond to an electromagnetic wave to change a refractive index of basic units of a metamaterial. In FIG. 9, the artificial metal microstructure is an H-shape, including an upright first metal branch 1021 and second metal branches 1022 that are respectively vertical to the first metal branch 1021 and located at both ends of the first metal branch. FIG. 10 is a derivative pattern of the geometry topology view of the artificial metal microstructure in FIG. 9, where the artificial metal microstructure includes not only the first metal branch 1021 and the second metal branches 1022, but also third metal branches 1023 are set vertically at both ends of each second metal branch.

Figure 11:
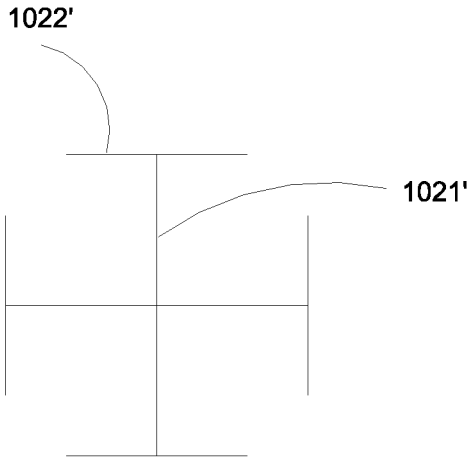
FIG. 11 is a geometry topology view of a second preferred implementation manner of artificial metal microstructures that can respond to an electromagnetic wave to change a refractive index of basic units of a metamaterial.
Figure 12:
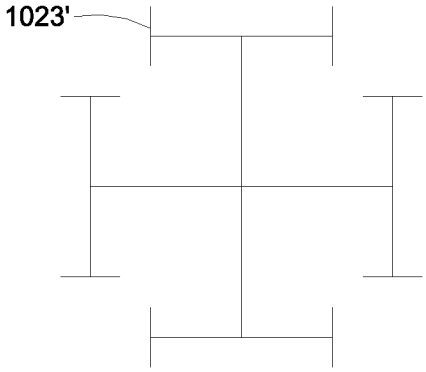
FIG. 12 is a derivative pattern of the topology view of the geometry of the artificial metal microstructures in FIG. 11.

FIG. 11 is a geometry topology view of a second preferred implementation manner of artificial metal microstructures that can respond to an electromagnetic wave to change a refractive index of basic units of a metamaterial. In FIG. 11, the artificial metal microstructure is a planar snowflake shape, which includes first metal branches 1021' vertical to each other, and second metal branches 1022' are set vertically at both ends of the two first metal branches 1021'. FIG. 12 is a derivative pattern of the geometry topology view of the artificial metal microstructure in FIG. 11. It includes not only two first metal branches 1021' and four second metal branches 1022', but also third metal branches 1023' are vertically set at both ends of the four second metal branches. Preferably, the first metal branches 1021' have equal lengths and vertically intersect at the midpoint; the second metal branches 1022' have equal lengths and their midpoint is located at an endpoint of the first metal branch; the third metal branches 1023' have equal lengths and their midpoint is located at an endpoint of the second metal branch; and the setting of the metal branches causes the artificial metal microstructures to be isotropic, that is, when the artificial metal microstructure is rotated by 90° in any direction in a plane in which the artificial metal microstructure is located, the rotated artificial metal microstructure coincides with the original artificial metal microstructure. The application of the isotropic artificial metal microstructures can simplify design and reduce interference.

The disclosure uses distinctive electromagnetic properties of the metamaterial, and performs reflection of the electromagnetic wave for multiple times to improve aperture efficiency of the antenna and accomplish good far-field radiation field responses. A through-hole is designed at the center point of the second metamaterial. The through-hole causes a part of the electromagnetic wave emitted by the feed to emit, where the part has the highest energy, thereby effectively preventing loss caused by emitting the electromagnetic wave to an aperture plane of the feed, enhancing a peak value of a main lobe, and reducing the level of a side lobe. In addition, the design of reflecting the electromagnetic wave for multiple times reduces thickness of the antenna significantly and makes an antenna system smaller.

Although the embodiments of the disclosure have been described with reference to accompanying drawings, the disclosure is not limited to the specific implementation manners. The specific implementation manners are merely illustrative rather than restrictive. As enlightened by the disclosure, persons of ordinary skill in the art may derive many other implementation manners without departing from the essence of the disclosure and the protection scope of the claims of the disclosure, which shall all fall within the protection scope of the disclosure.

What is claimed is:

1. A metamaterial antenna, comprising an enclosure, a feed, a first metamaterial that clings to an aperture edge of the feed, a second metamaterial that is separated by a preset distance from the first metamaterial and is set oppositely, and a third metamaterial that clings to an edge of the second metamaterial and inserts into the second metamaterial wherein the enclosure, the feed, the first metamaterial, the second metamaterial, and the third metamaterial make up a closed cavity; and a central axis of the feed penetrates center points of the first metamaterial and the second metamaterial; and a reflection layer for reflecting an electromagnetic wave is set on surfaces of the first metamaterial and the second metamaterial, wherein the surfaces are located outside the cavity;

wherein an electromagnetic wave emitted to the second metamaterial passes through the reflection layer and then bypasses the feed and is reflected onto the first metamaterial; and an electromagnetic wave emitted to the first metamaterial passes through the reflection layer and then bypasses the second metamaterial and is reflected onto the third metamaterial, and, after passing through the third metamaterial, the electromagnetic wave is converted into a plane wave and then emitted;

wherein the first metamaterial comprises multiple first metamaterial sheet layers, each first metamaterial sheet layer comprises a first substrate and multiple first artificial metal microstructures that are cyclically distributed on the first substrate, refractive indexes at different points of the first metamaterial sheet layer are distributed in a circular shape, a refractive index at a circle center is smallest, the refractive indexes increase gradually with increase of a radius that uses a center point of the first metamaterial sheet layer as a circle center, and, the refractive index is the same at the same radius; and wherein the second metamaterial is used to convert the electromagnetic wave emitted onto the second metamaterial into a plane wave through reflection, and then emit the plane wave onto the first metamaterial, and, by using a center point of the second metamaterial as a circle center, the refractive index $n_2(y)$ at a radius y satisfies the following formula:

$$n_2(y) = n_{min2} + \frac{1}{d_2} * (ss + |y| * \sin\theta_2 - \sqrt{ss^2 + y^2}\text{; and}$$

$$\sin\theta_2 \geq \frac{r_k}{\sqrt{r_k^2 + ss^2}},$$

$n_{min2}$ Is a minimum refractive index of the second metamaterial, $d_2$ is the thickness of the second metamaterial, ss is a distance from the feed to the second metamaterial, and $r_k$ is a radius of an aperture plane of the feed.

2. The metamaterial antenna according to claim 1, wherein a central region of the second metamaterial is a through-hole.

3. The metamaterial antenna according to claim 1, wherein the second metamaterial comprises multiple second metamaterial sheet layers, each second metamaterial sheet layer comprises a second substrate and multiple second artificial metal microstructures that are cyclically distributed on the second substrate, refractive indexes at different points of the second metamaterial sheet layer are distributed in a circular shape, a refractive index at a circle center is smallest, the refractive indexes increase gradually with increase of a radius that uses a center point of the second metamaterial sheet layer as a circle center, and, the refractive index is the same at the same radius.

4. The metamaterial antenna according to claim 3, wherein the first metamaterial is used to convert the electromagnetic wave emitted onto the first metamaterial into a plane wave through reflection, and then emit the plane wave onto the third metamaterial, and, by using a center point of the first metamaterial as a circle center, the refractive index $n_1(y)$ at a radius y satisfies the following formula:

$$n_1(y) = n_{min1} + \frac{1}{d_1} * (|y| - r_k) * (\sin\theta_1 - \sin\theta_2);$$

$$\sin\theta_1 \geq \frac{r_2 - r_k}{\sqrt{(r_2 - r_k)^2 + ss^2}}\text{; and}$$

-continued $$\sin\theta_2 \geq \frac{r_k}{\sqrt{r_k^2 + ss^2}},$$

wherein, $n_{min1}$ is a minimum refractive index of the first metamaterial, $d_1$ is thickness of the first metamaterial, ss is a distance from the feed to the second metamaterial, and $r_k$ is a radius of an aperture plane of the feed.

5. The metamaterial antenna according to claim 1, wherein the third metamaterial comprises a function layer formed by stacking multiple functional metamaterial sheet layers of the same thickness and the same refractive index profile, each functional metamaterial sheet layer comprises a third substrate and multiple third artificial metal microstructures that are cyclically distributed on the third substrate, refractive indexes of the functional metamaterial sheet layer are distributed in a concentric circle shape that uses a center point of the functional metamaterial sheet layer as a circle center, a refractive index at the circle center is greatest, and, the refractive index is the same at the same radius; and a refractive index profile on the functional metamaterial sheet layer is obtained according to the following steps:

S1: determining a region in which the third metamaterial is located and a boundary of each functional metamaterial sheet layer, wherein the region of the third metamaterial is filled with air, fixing the feed in front of the region of the third metamaterial and causing a central axis of the feed to coincide with a central axis of the region of the third metamaterial; and, after the feed emits an electromagnetic wave, testing and recording an initial phase on a front surface of the $i^{th}$ functional metamaterial sheet layer on the functional layer of the third metamaterial, wherein an initial phase at each point on the front surface of the $i^{th}$ functional metamaterial sheet layer is denoted by $\phi_{i0}(y)$, and an initial phase at the central axis is denoted by $\phi_{i0}(0)$;

S2: according to a formula $$\Psi = \varphi_{i0}(0) - \frac{\sum_i^M n_{max3} d}{\lambda} * 2\pi,$$

obtaining a phase $\Psi$ on a back surface of the third metamaterial, wherein, M is a total number of the functional metamaterial sheet layers that make up the functional layer of the third metamaterial, d is thickness of each functional metamaterial sheet layer, $\lambda$ is a wavelength of the electromagnetic wave emitted by the feed, and $n_{max3}$ is a maximum refractive index value of the functional metamaterial sheet layer; and S3: according to the initial phase $\phi_{i0}(y)$ obtained through the test in step S1, the reference phase $\Psi$ obtained in step S2, and the formula $$\Psi = \varphi_{i0}(y) - \frac{\sum_i^M n_3(y) d}{\lambda} * 2\pi,$$

obtaining a refractive index profile $n_3(y)$ of the functional metamaterial sheet layer, wherein, y is a distance from any point on the functional metamaterial sheet layer to the central axis of the functional metamaterial sheet layer.

6. The metamaterial antenna according to claim 5, wherein the third metamaterial further comprises the first to the $N^{th}$ impedance matching layers that are symmetrically set on both sides of the functional layer, wherein two $N^{th}$ impedance matching layers cling to the functional layer.

7. The metamaterial antenna according to claim 6, wherein the first to the $N^{th}$ impedance matching layers are the first to the $N^{th}$ matching metamaterial sheet layers, each matching metamaterial sheet layer comprises a fourth substrate and multiple fourth artificial metal microstructures that are cyclically distributed on the fourth substrate, refractive indexes of each matching metamaterial sheet layer are distributed in a concentric circle shape that uses a center point of the matching metamaterial sheet layer as a circle center, a refractive index at the circle center is greatest, and, the refractive index is the same at the same radius; and, on the first to the $N^{th}$ matching metamaterial sheet layers, the refractive indexes at the same radius are different.

8. The metamaterial antenna according to claim 7, wherein a relationship between the refractive index profile of the first to the $N^{th}$ matching metamaterial sheet layers and the refractive index profile $n_3(y)$ of the functional metamaterial sheet layer is:

$$N(y)_j = n_{min3} + \frac{j}{N+1} * (n_3(y) - n_{min3}),$$

wherein, j represents serial numbers of the first to the $N^{th}$ matching metamaterial sheet layers, and $n_{min3}$ is a minimum refractive index value of the functional metamaterial sheet layer.

9. The metamaterial antenna according to claim 7, wherein the third substrate and the fourth substrate are made of the same material, and the third substrate and the fourth substrate are made of a polymer material, a ceramic material, a ferroelectric material, a ferrite material, or a ferromagnetic material.

10. The metamaterial antenna according to claim 7, wherein the third artificial microstructure and the fourth artificial microstructure have the same material and geometry.

11. The metamaterial antenna according to claim 10, wherein the third artificial microstructure and the fourth artificial microstructure are metal microstructures of an H-shaped geometry, and the metal microstructures comprise an upright first metal branch and two second metal branches that are located at both ends of the first metal branch and vertical to the first metal branch.

12. The metamaterial antenna according to claim 11, wherein the metal microstructures further comprise third metal branches that are located at both ends of each second metal branch and vertical to the second metal branch.

13. The metamaterial antenna according to claim 10, wherein the third artificial microstructure and the fourth artificial microstructure are metal microstructures of a planar snowflake geometry, and the metal microstructures comprise two first metal branches that are vertical to each other and second metal branches that are located at both ends of the first metal branches and vertical to the first metal branches.

* * * * *